US005115742A

United States Patent [19]

Frazer

[11] Patent Number: 5,115,742

[45] Date of Patent: May 26, 1992

[54] INTEGRATED AND MECHANICALLY AIDED WARHEAD ARMING DEVICE

[75] Inventor: Alson C. Frazer, Santa Ana, Calif.

[73] Assignee: United States of America as represented by the Secretary of the Navy

[21] Appl. No.: 719,426

[22] Filed: Jun. 24, 1991

[51] Int. Cl.[5] ..... F42C 15/40

[52] U.S. Cl. ..... 102/208; 102/206; 102/225

[58] Field of Search ..... 102/208, 206, 263, 262, 102/265, 225

[56] References Cited

U.S. PATENT DOCUMENTS

| | | | |
|---|---|---|---|
| 1,311,785 | 7/1919 | Wildrick | 102/208 |
| 3,757,695 | 9/1973 | Fisher | 102/208 |
| 4,567,828 | 2/1986 | Campagnuolo et al. | 102/208 |
| 4,586,436 | 5/1986 | Denney et al. | 102/208 |
| 4,603,635 | 8/1986 | Boudreau | 102/206 |
| 4,615,269 | 10/1986 | Holder | 102/221 |
| 4,651,646 | 3/1987 | Foresman et al. | 102/208 |
| 4,739,705 | 4/1988 | Hudson et al. | 102/222 |
| 4,800,814 | 1/1989 | Holt et al. | 102/226 |
| 4,964,593 | 10/1990 | Kranz | 102/208 |

*Primary Examiner*—David H. Brown

*Attorney, Agent, or Firm*—John D. Lewis; Kenneth E. Walden

[57] ABSTRACT

An integrated and mechanically aided warhead afterbody arming device for missiles using mechanical rotation of the missile to arm the warhead is disclosed. A self-contained electrical generation system provides electrical power for the proper arming of the warhead. Mechanical rotation energy is used to generate electrical power for warhead arming. Revolution counters and mechanical detents are used to prevent premature arming.

6 Claims, 1 Drawing Sheet

INTEGRATED AND MECHANICALLY AIDED WARHEAD ARMING DEVICE

ORIGIN OF THE INVENTION

The invention described herein was made in the performance of official duties by an employee of Ford Aerospace Corporation, now Loral Aerospace Corporation, while fulfilling the terms of contract N60921-89-C-A136 for the Department of the Navy and may be manufactured, used, licensed by or for the Government for any governmental purpose without payment of any royalties thereon.

FIELD OF THE INVENTION

The invention relates to arming devices for missile warheads and more particularly to warhead arming devices using mechanical rotation.

BACKGROUND OF THE INVENTION

Missiles are typically ejected from a housing or support by means of a mechanical ejector, an expulsion charge or a thrust motor. Missiles of this type frequently use a rotating afterbody, either driven by the rocket exhaust or by aerodynamic fins, in order to achieve improved stability. In order to assure safe operation, it is desirable that the warhead of a missile not be armed until after the missile has separated and traveled a predetermined distance from its housing or support.

Prior art systems for arming sequence initiation are often mechanical in nature and tend to be complex both in structure and operation. Because of this mechanical complexity, reliability of the devices is of concern and a certain number of failures can be expected. Furthermore, the requirement that the missile not arm prior to safe separation means that any unreliability must be designed to fail safe instead of allowing an unintended arming. However, such fail safe design often results in warheads that fail to arm after firing.

To assure safe arming, conventional arming devices make use of separation sensors and timers. Unfortunately, these components add weight and volume which may significantly impact system design. Conventional arming devices also use on-board battery power as a source of electrical power for warhead arming. However, the loss of battery power results in a failure to arm.

SUMMARY OF THE INVENTION

Accordingly, an object of the invention is to provide an arming device such that a missile warhead only becomes armed once the missile has been launched and has traveled a minimum "safe" distance from its launch point.

Another object of the invention is to avoid the use of an on-board battery for proper arming of a warhead by providing a self-contained electrical generation system.

A further object of the invention is to provide an arming device which is safe to handle in storage and transit and cannot be activated by stray electromagnetic waves.

It is another object of the invention to provide a highly reliable arming device.

Yet another object of the invention is to provide a small, lightweight, simple and low-cost arming device.

In accordance with the objects, the invention is an integrated and mechanically-aided warhead arming device for missiles. The device provides a new combination using already available mechanical energy produced by rotation of the afterbody of the missile (having this rotating design) to generate which in turn is used for the actual arming sequence. Electrical energy produced by the rotating afterbody energizes a capacitor. The capacitor becomes fully charged after a predetermined revolution count of the rotating afterbody of the missile, thereby providing sufficient electrical charge for arming the warhead. Pre-launch arming is prevented by a mechanical detent which: 1) engages the forebody and afterbody under normal handling conditions and, 2) allows rotation of the afterbody under normal operating conditions. This new and novel device is designed to arm the warhead reliably while providing a system which is extremely safe.

DETAILED DESCRIPTION OF THE INVENTION

Figure 1:
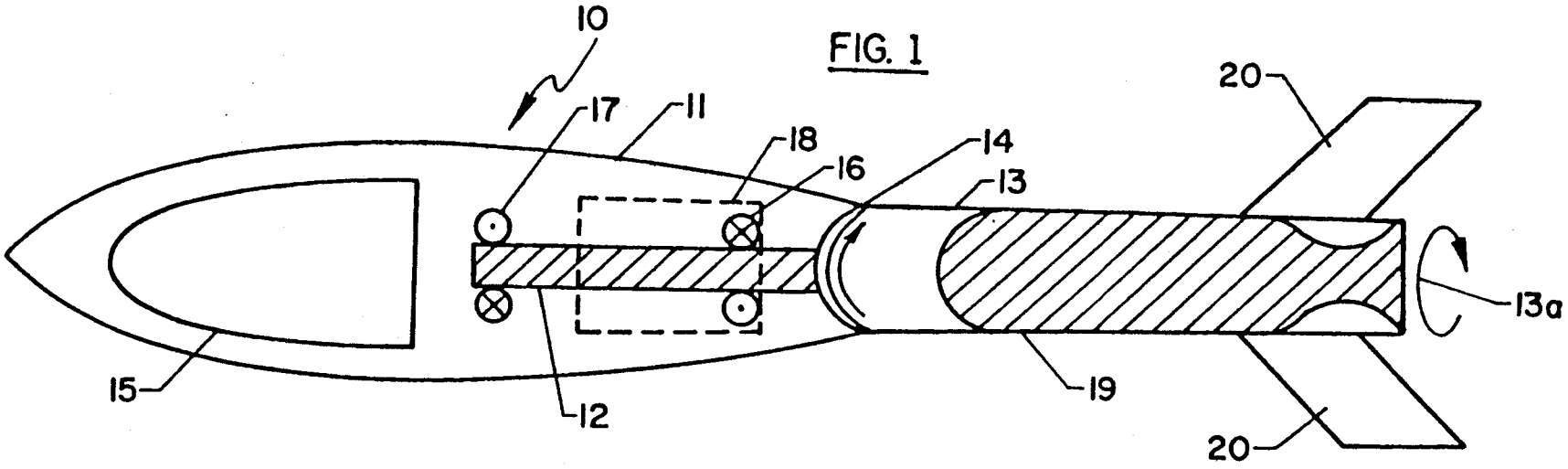
FIG. 1 is a side view with cutaway showing the mechanical components of the warhead arming device of the present invention.

Referring now to the drawings and in particular to FIG. 1, a missile 10 in the preferred embodiment comprises a forebody 11 and a rotating afterbody 13 rotatably connected as conventionally known and practiced in the art by a shaft 12. The invention combines a mechanical source of energy with electric and electronic components to provide an enhanced system for arming warheads. In the preferred embodiment, launch of missile 10 occurs by the reaction force of a solid fuel rocket 19. The developed thrust in combination with tail fins 20 imparts spin to the afterbody 13 and shaft 12 rigidly connected thereto as indicated by directional arrow 13*a*. The impartation of spin is typically required for the management of aerodynamic and thrust masalignment forces present when missiles are fired. In the present invention, the rotation of the afterbody 13 reduces the single plane magnitude of thrust masalignment forces that are intrinsic to the development of thrust by a solid propellant rocket. Rotational energy is derived initially from the extraction of torque from the primary propulsion system nozzle flow and is sustained during flight by aerodynamic forces produced by the design of tail fins 20. This mechanical energy is implicitly available to be converted to electric energy.

The conversion of mechanical energy to electrical energy may be achieved in a variety of ways. In the preferred embodiment a primary field winding 16 is provided within non-rotating forebody 11 about shaft 12. Field winding 16 thus generates a magnetic field as shaft 12 rotates in conjunction with afterbody 13. Accordingly, shaft 12, acts as an armature extending from and connected to rotating afterbody 13. The combination of rotating shaft 12 and field winding 16 constitutes an alternator assembly 18. The electrical output of alternator assembly 18 is used to charge an energy source, such as a capacitor in the preferred embodiment, for the arming of missile warhead 15. Rotation of forebody 11 due to friction with the afterbody 13 may be prevented by a separate conventional closed loop interface. One such interface comprises a secondary field winding 17 about shaft 12 as shown. A reverse EMF is thereby generated in field winding 17 opposing the torque produced by afterbody 13 to prevent rotation of forebody 11.

Electrical energy cannot be generated until the afterbody 13 is allowed to rotate with respect to the forebody 11. The rotational freedom of the afterbody 13 is restricted prior to launch by use of a mechanical detent (not shown) disposed at the juncture 14 of forebody 11 and afterbody 13. The detent may be chosen from a variety of mechanical detents, such as ball release devices already well-known in the art. Functionally, the detent: 1) prevents the rotation of afterbody 13 with respect to forebody 11 during normal, non-launch mode handling conditions, 2) permits the start of rotation of afterbody 13 once a large force, such as a force of launch, is applied to the detent to release same at juncture 14, and 3) allows for continuous rotation of afterbody 13 with respect to forebody 11 after the launch force is removed. Thus, the missile 10 may be handled safely prior to launch since manual rotation of afterbody 13 relative to forebody 11 is prevented by the detent. Since the only source of power for arming warhead 15 is the alternator assembly 18, it is impossible to arm warhead 15 without rotating the afterbody 13 in relation to the forebody 11.

Figure 2:
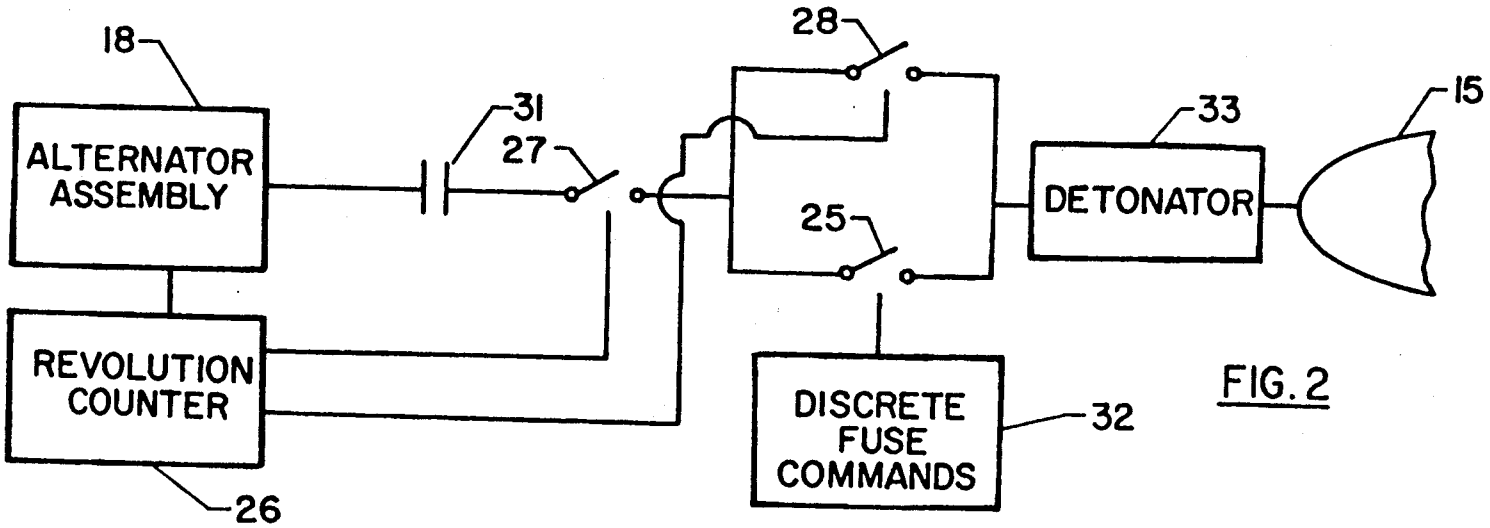
FIG. 2 is a schematic drawing of electrical and electronic components of the warhead arming device of the present invention.

A novel feature of the invention is the separation of the warhead arming function from any failure mode prior to launch as will now be described with the aid of FIG. 2. Alternator assembly 18 is functionally connected to and charges a capacitor 31. A conventional revolution counter 26, having logic circuitry, is used to equate each revolution of afterbody 13 to a fixed longitudinal distance traveled and/or the time constant of capacitor 31. After a predetermined number of revolutions of afterbody 13, indicative of a safe separation distance traveled by missile 10, an electrical safe separation switch 27 is closed. Once safe separation switch 27 has been closed, the completion of the electrical path between charged capacitor 31 and a detonator 33 is controlled by typical discrete fuze commands 32. Detonator 33 may be an exploding foil initiator or any common detonator known in the art functionally connected to warhead 15. The discrete fuze commands 32 may be generated by such events as detecting a near miss, detecting a direct hit, or detecting a grazing impact, any one or combination of which will cause switch 25 to be activated. Revolution counter 26 may also cause switch 28 to close thus completing the electrical path for a self-destruct circuit. Self-destruction may be desired at a predetermined time and distance beyond which the missile is ineffective. The predetermined time and distance is equated to a predetermined number of revolutions of afterbody 13.

By disposing field winding 16 in the forebody 11 around rotating shaft 12, having an armature winding, electrical energy is generated. The effect of electrical energy generation on rotational speed of the afterbody 13 is negligible. Therefore there is no adverse impact on aerodynamic and thrust management by the present invention due to warhead arming by the present invention. Typical values for the applications studied suggest that less than ten percent of the rotational energy is drawn from: the afterbody 13 to perform the warhead arming functions for which this invention is intended.

The system provides a means for controlling the charging of capacitor 31 and its subsequent discharge to a warhead detonator 33. The successful ignition of detonator 33 in the system results in detonation of warhead 15. Electrical discharge produced by the capacitor 31 must meet specific voltage and current values dependent upon the type of detonator used. In the preferred embodiment, capacitor 31 cannot be charged to the specific voltage and current values until after launch since rotation of afterbody 13 is required to generate electrical energy required for charging.

The requirement of a launch force to decouple bodies 11 and 13, followed by rotation of afterbody 13 to thereby charge capacitor 31, provides a particularly safe system. Thus, numerous safety related advantages are achieved by the present invention with respect to the prior art. Pre-launch safety is assured because there is no electrical power source to charge capacitor 31 until after a successful launch. The chance of a malfunction in handling and common failure modes associated with prior art systems, including an inadvertent initiation by a battery power source, are eliminated. In-flight safety is assured by preventing premature charging of capacitor 31 until a predetermined distance has been traveled since the rotation rate scales with the longitudinal rate of travel. Therefore, even in soft or low thrust launches with slower missile velocities resulting in a reduced rate of revolution of afterbody 13, capacitor 31 cannot be charged until a predetermined distance has been traveled.

Although the invention has been described relative to a specific embodiment thereof, there are numerous variations and modifications that will be readily apparent to those skilled in the art in the light of the above teachings. It is therefore to be understood that, within the scope of the appended claims, the invention may be practiced other than as specifically described.

What is claimed as new and desired to be secured by Letters Patent of the United States is:

1. A warhead arming device for a missile comprising:
- a forebody;
- a rotating afterbody connected with a rotatable joint to said forebody;
- an alternator assembly for generating electrical energy from said rotating afterbody;
- a capacitor electrically connected to said alternator assembly;
- a safe separation measurement device functionally connected to said alternator assembly;
- a fuzing system electrically connected to said capacitor; and
- a detonator electrically connected to said fuzing assembly for arming the missile warhead.

2. A warhead arming device as in claim 1 wherein said alternator assembly further comprises:
- a shaft rigidly connected to said rotating afterbody, said shaft extending into said forebody; and
- a field winding fixed to said forebody and surrounding said shaft.

3. A warhead arming device as in claim 1 wherein said safe separation measurement device further comprises a revolution counter.

4. A warhead arming device for an in-flight missile comprising:
- a forebody of the missile housing a warhead;
- an afterbody of the missile rotatably connected to said forebody, thereby allowing afterbody rotation during missile flight;
- means for generating electrical energy from said afterbody rotation;
- a capacitor connected to said generating means for storing the electrical energy;

means for determining a safe separation distance traveled by the missile based on said afterbody rotation; and means for causing said capacitor to discharge after separation distance and thereby providing power for warhead arming.

5. A warhead arming device as in claim 4 wherein said means for generating electrical energy further comprises a primary field winding disposed in said forebody and surrounding a shaft rigidly attached to and extending from the rotatably afterbody.

6. A warhead arming device as in claim 4 wherein said means for determining said safe separation distance further comprises a revolution counter electrically connected to said means for generating electrical energy and having logic circuits which equate the revolution of said rotatable afterbody to a fixed longitudinal distance traveled.

* * * * *